US006318459B1

(12) United States Patent
Wright et al.

(10) Patent No.: US 6,318,459 B1
(45) Date of Patent: Nov. 20, 2001

(54) DEVICE FOR ANCHORING AN OIL WELL TUBING STRING WITHIN AN OIL WELL CASING

(75) Inventors: Andrew J. Wright, Leduc; Michael Wawrzynowski, Edmonton, both of (CA)

(73) Assignee: Gadu, Inc., Bridgetown (BB)

( * ) Notice: Subject to any disclaimer, the term of this patent is extended or adjusted under 35 U.S.C. 154(b) by 0 days.

(21) Appl. No.: 09/370,477

(22) Filed: Aug. 9, 1999

(51) Int. Cl.[7] ..... E21B 23/01
(52) U.S. Cl. ..... 166/117.6; 166/382; 166/217
(58) Field of Search ..... 166/382, 117.7, 166/117.6, 206, 2.17, 139, 216

(56) References Cited

U.S. PATENT DOCUMENTS

| | | | | |
|---|---|---|---|---|
| 4,750,559 | * | 6/1988 | Greenlee et al. | 166/216 |
| 4,883,121 | * | 11/1989 | Zwart | 166/217 |
| 5,197,546 | * | 3/1993 | Murray | 166/382 |
| 5,636,690 | * | 6/1997 | Garay | 166/216 |
| 5,829,531 | * | 11/1998 | Hebert et al. | 166/382 |
| 6,062,309 | * | 5/2000 | Gosse | 166/216 |
| 6,073,693 | * | 6/2000 | Aldridge | 166/217 |

* cited by examiner

*Primary Examiner*—David Bagnell
*Assistant Examiner*—Jennifer R. Dougherty
(74) *Attorney, Agent, or Firm*—Merek & Voorhees

(57) ABSTRACT

An anchoring device for anchoring an oil well tubing string within an oil well casing. The device generally comprises a drive mandrel and an anchor mandrel. The drive mandrel has an upper end and a lower end, with the upper end releasably securable to an oil well tubing string. The anchor mandrel has an upper end that is releasably securable to the drive mandrel. The anchor mandrel is selectively engagable and disengagable with the interior surface of an oil well casing through the use of a plurality of rotatable slips. The slips have a gripping surface to contact and adhere to the interior surface of the oil well casing such that when the anchor mandrel is rotated in a first direction the slips are rotatably deployed to an engaged position with the gripping surfaces in contact with the interior surface of the oil well casing. Rotation of the anchor mandrel in a second opposite direction causes the slips to be rotatably retracted from their engaged position to a disengaged position such that the gripping surfaces are withdrawn from contact with the interior surface of the oil well casing. A shear mechanism may be employed between the drive and anchor mandrels to alow for controled separation of the mandrels under predetermined tensile loading.

24 Claims, 7 Drawing Sheets

DEVICE FOR ANCHORING AN OIL WELL TUBING STRING WITHIN AN OIL WELL CASING

FIELD OF THE INVENTION

This invention relates to anchoring devices for use in oil wells, and in particular an anchoring device for releasably securing an oil well tubing string within an oil well casing.

BACKGROUND OF THE INVENTION

Production oil wells typically contain a well casing into which is inserted a production tubing string. The production tubing string serves as both a means to insert and remove a downhole pump and pump rod, and provides a conduit for the extraction of oil and fluids from the well. The upper end of the production tubing string is held within the well casing through the use of a variety of flanges, hangers, rotating heads, or similar devices. Attached at or near the lower end of the tubing string is a downhole pump that is most commonly either a reciprocating or a progressive cavity pump. Reciprocating pumps are traditional oil well pumps wherein the pump rod is reciprocated within the production tubing string by means of a pump jack or similar device. In progressive cavity pumps the pump rod is attached to a downhole rotor that is confined within a pump housing such that rotation of the pump rod causes the rotor to rotate and pump or drive oil and other fluids to the surface.

Regardless of the form or type of downhole pump utilized within the oil well, it is necessary to securely anchor the lower end of the production tubing string to the well casing. Anchoring the lower portion of the tubing string serves to hold it in place so that downhole equipment and the interior surface of the well casing are not damaged during operation as will be the case if the production tubing string were merely allowed to be suspended freely within the well casing. In addition, the downhole anchoring device serves to prevent the production tubing string from moving upwardly or downwardly, in the case of reciprocating pump, or from rotating, in the case of a progressive cavity pump, during pumping.

While others have proposed downhole anchoring devices having a variety of different configurations and methods of operation, existing anchors all suffer from a number of common limitations. First, many are mechanically complex and involve complicated and expensive mechanical structures in order to "set" them and anchor the production tubing string to the well casing. Many other current downhole anchors are severely limited in terms of their application in oil wells having a high sand content. In cases where oil is contained in sand formations, during production sand can often become tightly packed around the anchor making it difficult, and in some cases impossible, to release the anchor and remove it from the well when desired. Where the anchor fails to release, laborious and expensive flushing procedures must be employed in order to wash compacted sand from around the anchor allowing it to release. High pressure or sour gas wells add additional complications under such circumstances. Finally, prior downhole anchors have herebefore not provided a mechanism by which the production tubing string can be released from the anchor in the event that the anchor becomes jammed or sanded in while in its deployed state.

SUMMARY OF THE INVENTION

The invention therefore provides a device for anchoring an oil well tubing string within an oil well casing that is mechanically simple, inexpensive to construct, less prone to becoming jammed or immobilized when it becomes sanded in, and that in one embodiment further provides a means to separate the production tubing string from the anchoring mechanism in the event that the anchor should become jammed in its deployed configuration.

Accordingly, in one of its aspects the invention provides an anchoring device for anchoring an oil well tubing string within an oil well casing, the device comprising; a drive mandrel having an upper end and a lower end, said upper end releasably securable to an oil well tubing string; and, an anchor mandrel having an upper end that is releasably securable to said drive mandrel, and means for selectively engaging and disengaging the interior surface of an oil well casing, wherein said means for selectively engaging and disengaging the interior surface of an oil well casing comprises a plurality of rotatable slips, said slips having a gripping surface to contact and adhere to the interior surface of an oil well casing such that when said anchor mandrel is rotated in a first direction said slips are rotatably deployed to an engaged position with said gripping surfaces in contact with the interior surface of the oil well casing thereby anchoring said device to the casing and limiting further rotational movement in said first direction and limiting longitudinal movement of said device, and rotation of said anchor mandrel in a second opposite direction causes said slips to be rotatably retracted from said engaged position to a disengaged position such that said gripping surfaces of said slips are withdrawn from contact with the interior surface of the oil well casing.

In a further aspect the invention provides an anchoring device for anchoring an oil well tubing string within an oil well casing, the device comprising: an anchor mandrel having attached thereto anchoring means for selectively engaging and disengaging the interior surface of an oil well casing; a drive mandrel, said drive mandrel having an upper end releasably securable to an oil well tubing string and a lower end releasably securable to said anchor mandrel; and, a shear ring having an upper end, a lower end and a shear zone of reduced tensile strength located between said upper and said lower ends, said shear ring assisting in releasably securing said drive mandrel to said anchor mandrel such that when said drive mandrel is secured to said anchor mandrel tensile load applied between said drive mandrel and said anchor mandrel in excess of the yielding strength of said shear zone causes breakage of said shear ring along said shear zone and separation of said drive mandrel from said anchor mandrel.

Further objects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENT

Figures 1, 2:
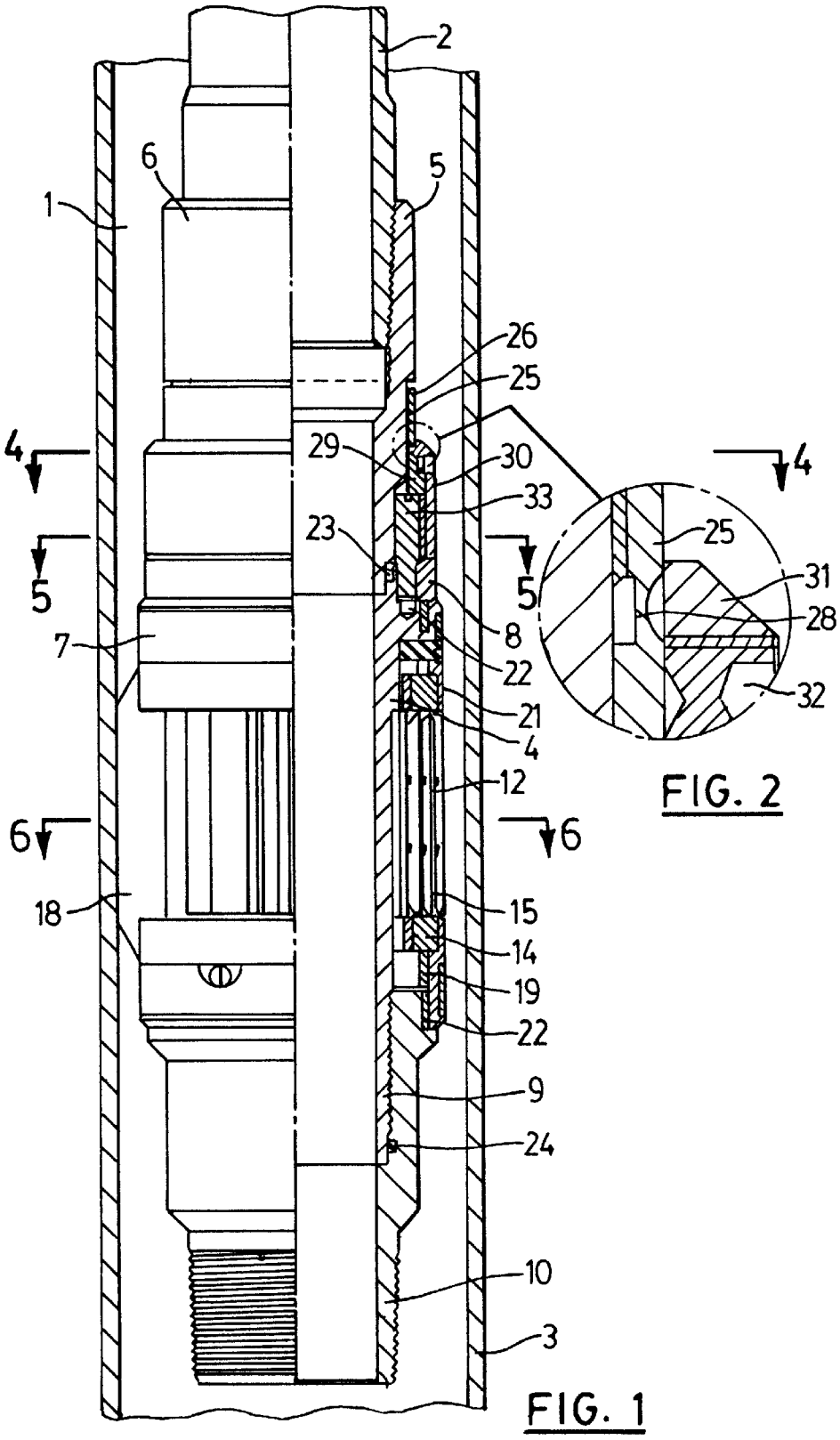
FIG. 1 is a side elevational view, in one quarter section, of the anchoring device pursuant to a preferred embodiment of the present invention wherein the anchor slips are disengaged from the oil well casing.
FIG. 2 is an enlarged detailed view of Area 2 shown in FIG. 1.
Figure 3:
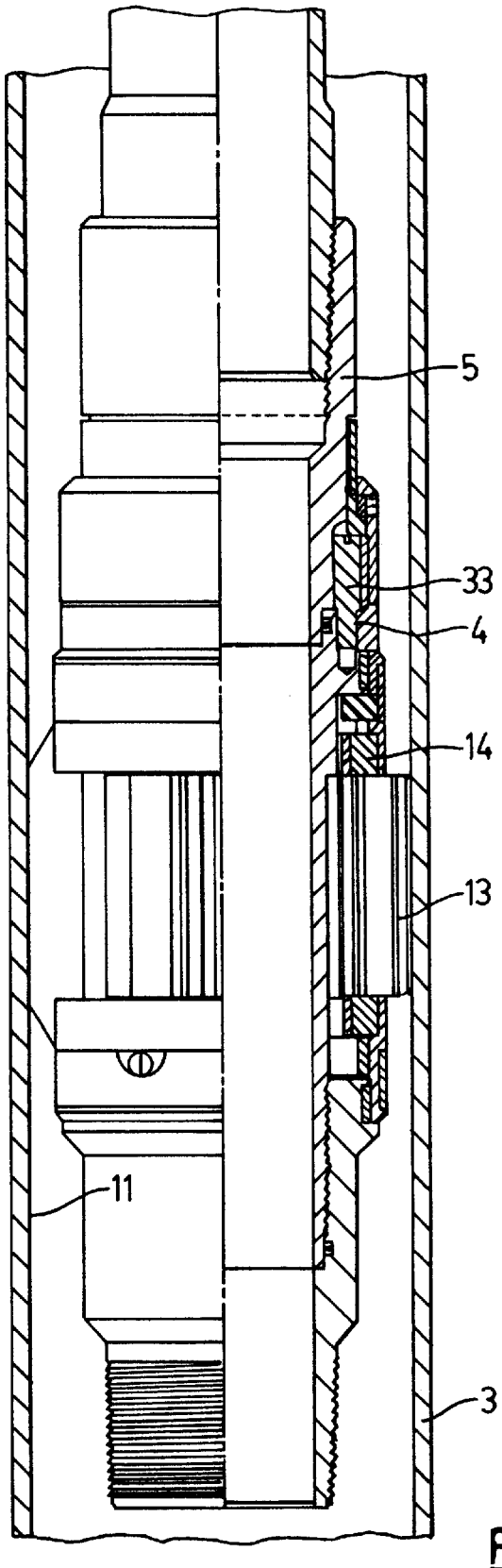
FIG. 3 is a side elevational view, in one quarter section, of the anchoring device pursuant to a preferred embodiment of the present invention wherein the anchor slips are deployed and engage the interior surface of the oil well casing.
Figure 4:
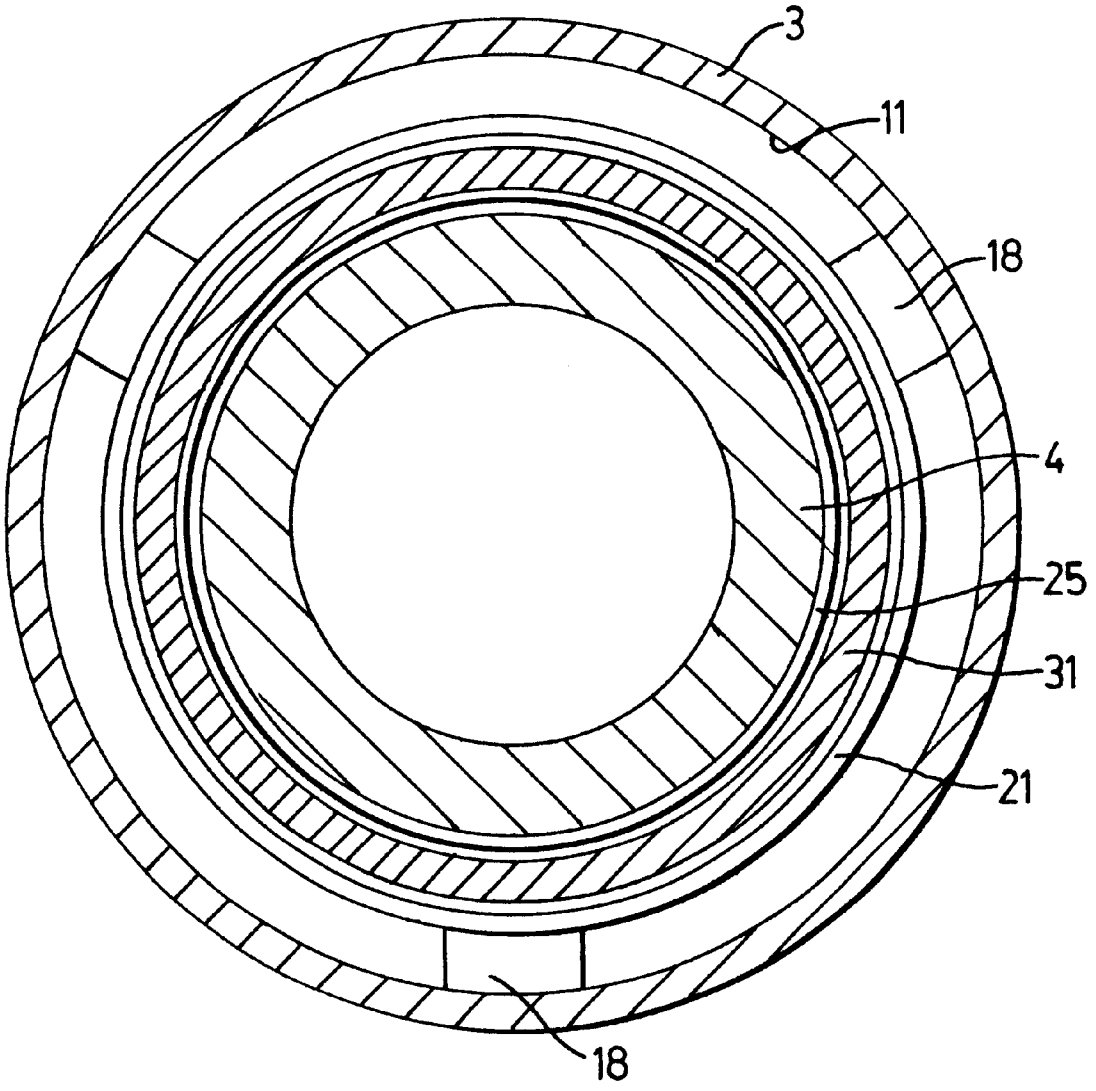
FIG. 4 is a sectional view taken along the line 4—4 of FIG. 1.
Figure 5:
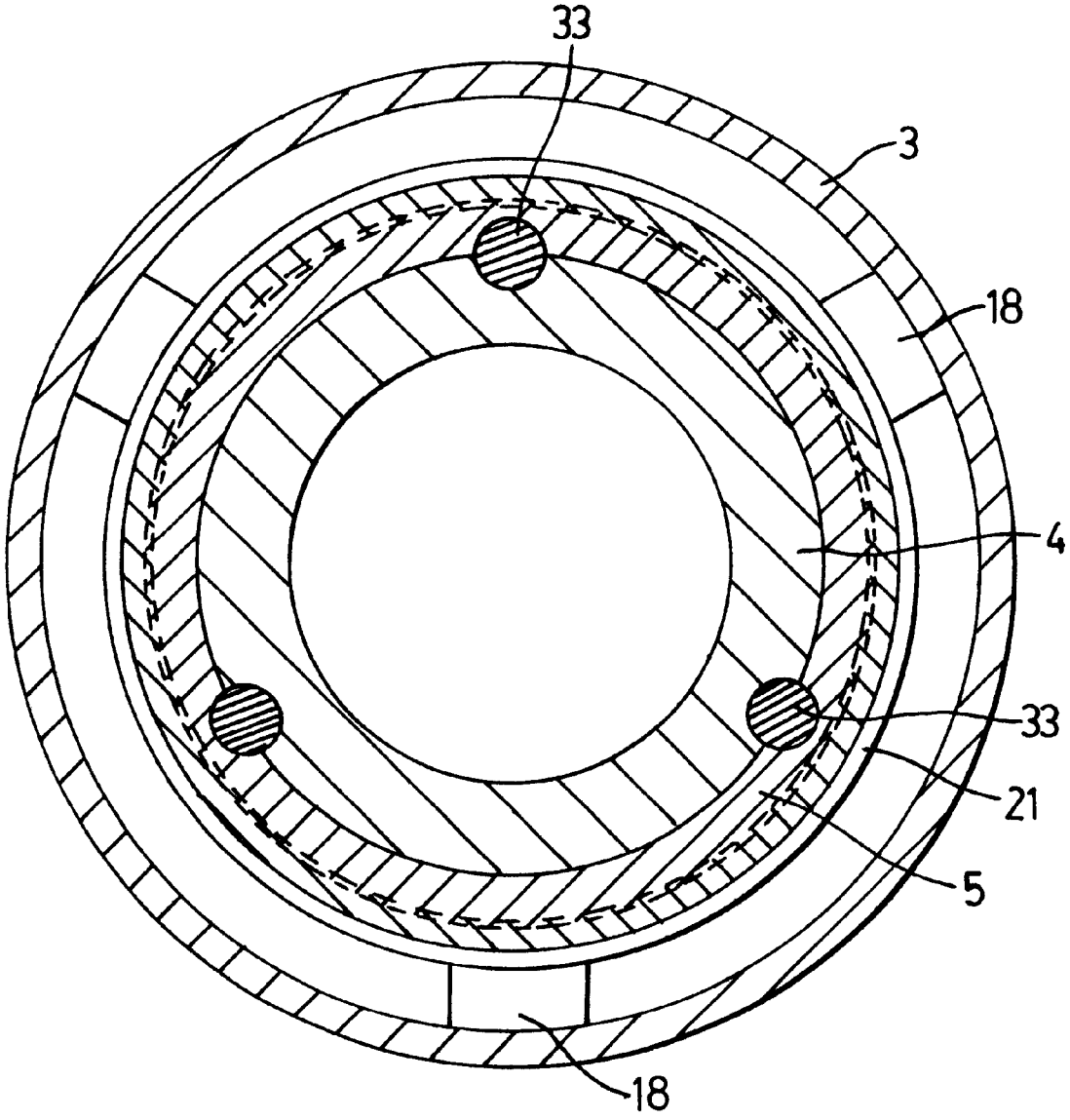
FIG. 5 is a sectional view taken along the line 5—5 of FIG. 1.

The present invention may be embodied in a number of different forms. However, the specification and drawings that follow describe and disclose only some of the specific forms of the invention and are not intended to limit the scope of the invention as defined in the claims that follow herein.

The anchoring device according to the present invention is identified generally in the attached drawings by reference numeral 1. Anchoring device 1 is used to anchor or secure an oil well tubing string 2 within oil well casing 3. The primary housing of anchoring device 1 is comprised an anchor mandrel 4 and a drive mandrel 5. Drive mandrel 5 has an upper end 6 and a lower end 7, with upper end 6 releasably securable to tubing string 2. Preferably the tubing string is threaded into the top portion of the drive mandrel. Lower end 7 of drive mandrel 5 is received within the upper end 8 of anchor mandrel 4 so as to allow the transmission of rotational force from the drive mandrel to the anchor mandrel, as is described in more detail below. The lower end 9 of anchor mandrel 4 is also preferably threaded so as to receive thereon a bottom sub 10 from which other tools, tubing or other structures may be hung.

Anchor mandrel 4 further contains means for selectively engaging and disengaging the interior surface 11 of well casing 3. In the preferred embodiment the means for selectively engaging and disengaging the interior surface of the well casing comprises a plurality of rotatable slips 12 that have gripping surfaces 13 to contact and adhere to the interior surface of the casing. As shown most clearly in FIGS. 1 and 7, slips 12 are elongate, generally rectangular, structures that are rotatably mounted on longitudinal axles 14, positioned and received within anchor mandrel 4 parallel to the longitudinal axis of the mandrel. Gripping surfaces 13, positioned on the outermost face of slips 12, are serrated, or formed with a series of generally longitudinally oriented blades 15, to assist in securing and adhering the slips to the interior surface of the casing when the slips are deployed in their engaged position.

It will therefore be appreciated that the manner in which slips 12 are received and secured within anchor mandrel 4 by way of axles 14 allows the slips to be rotatably deployable from a disengaged position where they are retracted and do not contact the interior surface of the well casing (see FIG. 1) to an engaged position where they are radially extended with gripping surfaces 13 and blades 15 contacting interior surface 11 of casing 3. In the preferred embodiment deployment of the slips from a disengaged position to an engaged position, and back again to a disengaged position, is accomplished through rotating anchor mandrel 4 in opposite directions. For example, in the embodiment shown in the attached Figures, rotation of anchor mandrel 4 in a clockwise direction results in deployment of the slips to their engaged position until they contact the interior surface of the well casing. Similarly, rotation of anchor mandrel 4 in a counter-clockwise direction results in a retraction of the slips until they are disengaged from the interior surface of the well casing and received more closely against the exterior of anchoring device 1.

It will thus be appreciated that through rotation of anchor mandrel 4 and deployment of slips 12 such that gripping surfaces 13 are driven into contact with the interior of the well casing, device 1 will become anchored to the well casing and limit vertical movement of the tubing string, as well as further rotational movement in a clockwise direction. This movement of the slips, referred to as "setting" the anchor, thereby accomplishes the desired result of securely anchoring device 1 to the well casing. Removal of the anchoring device merely requires rotation of anchor mandrel 4 in a counter-clockwise direction so as to disengage slips 12 from the well casing and once again allow rotational and/or vertical movement of the tool and the tubing string. It will also be appreciated that while the described structure functions in a manner such that the slips are deployed by way of a clockwise rotation and disengaged by means of a counter-clockwise rotation of anchor mandrel 4, the function of device 1 would be precisely the same in the event that anchor mandrel 4 and slips 12 were constructed so as to be deployed and disengaged by rotation in the opposite directions to those described above.

Figure 6:
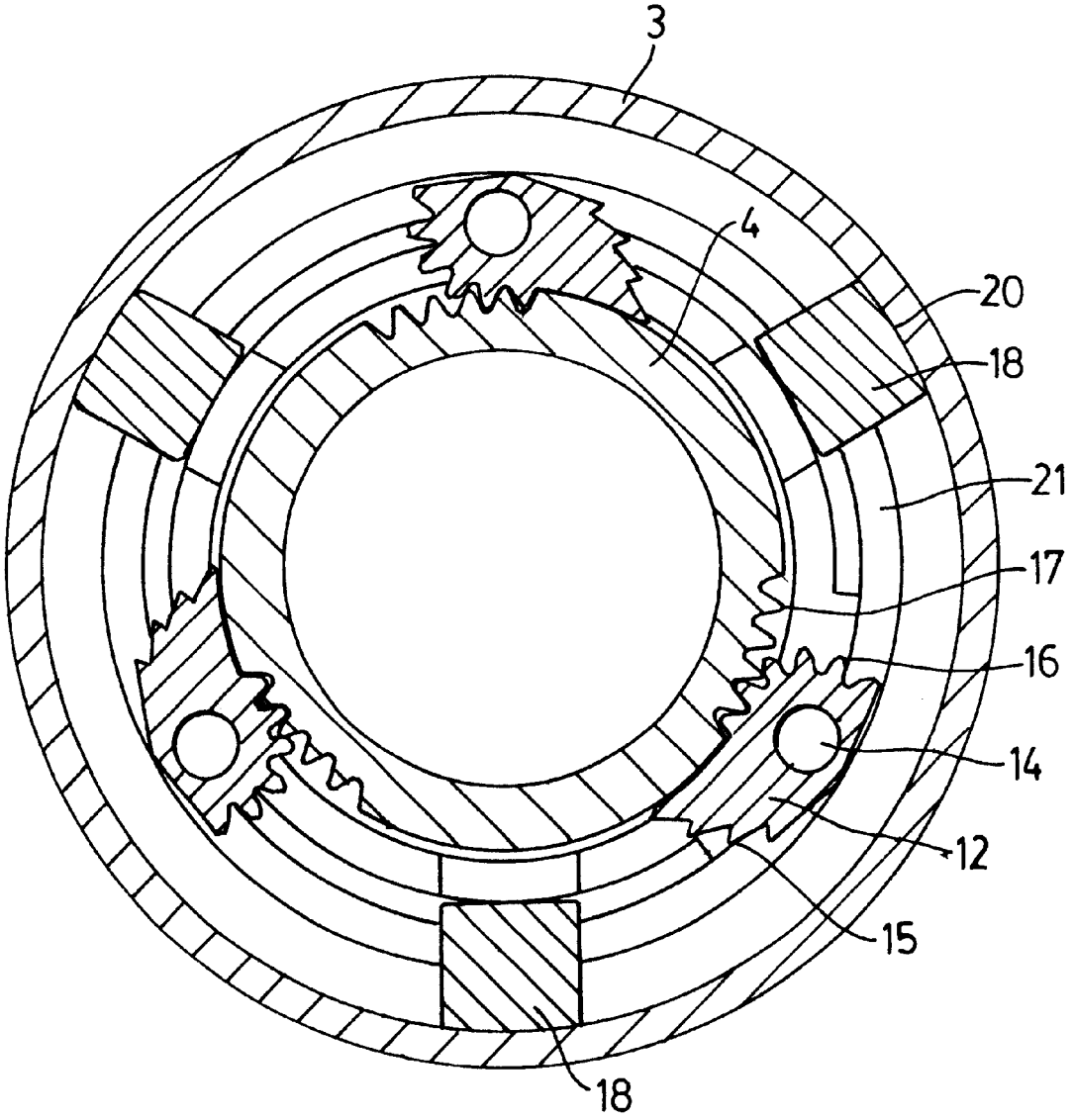
FIG. 6 is a sectional view taken along the line 6—6 of FIG. 1.
Figure 7:
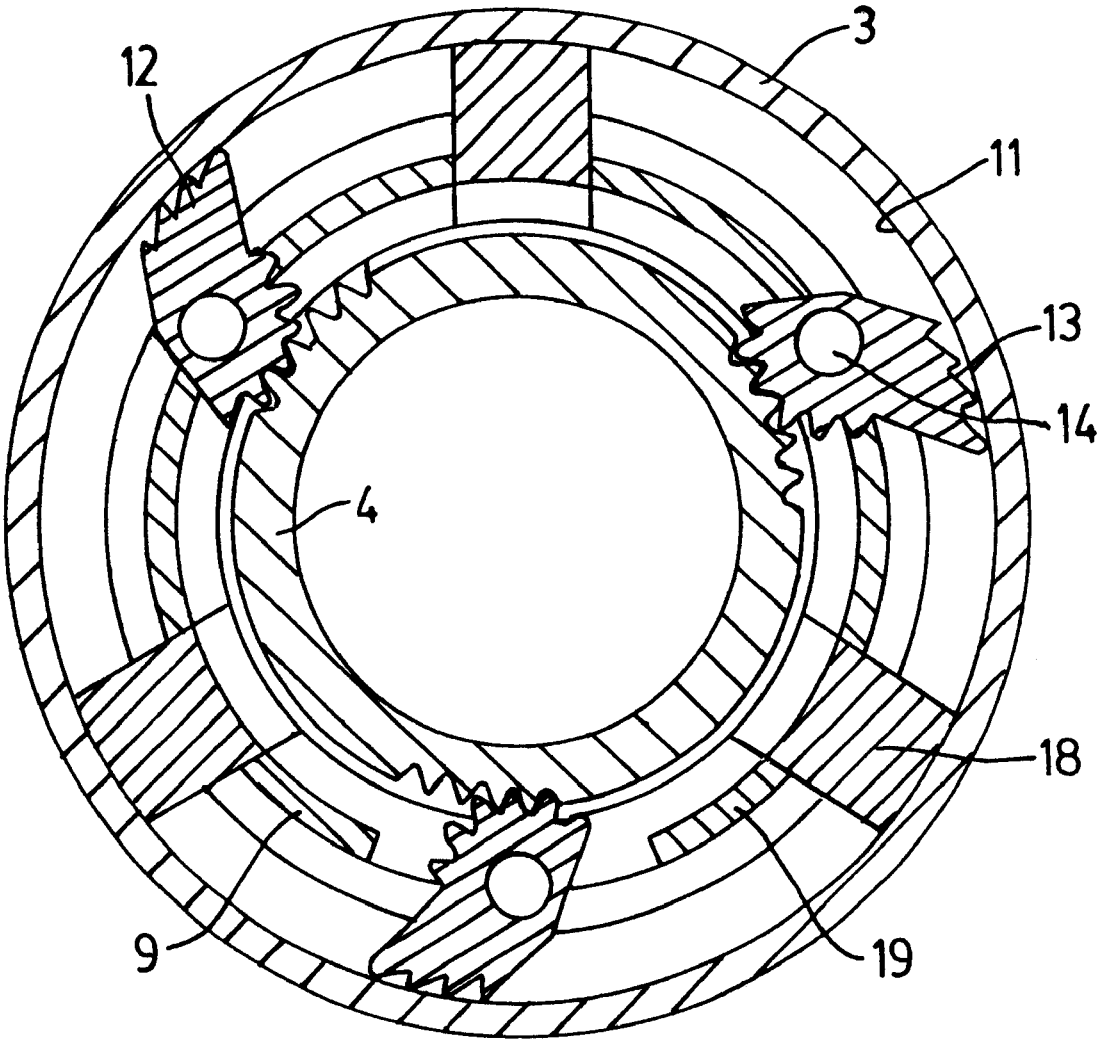
FIG. 7 is a sectional view taken along the line 7—7 of FIG. 3; and, FIG. 8 is a side elevational view, in one quarter section, of an alternate embodiment of the anchoring device of the present invention wherein the anchor slips are disengaged from the interior surface of the oil well casing.

The mechanical structure by which rotation of anchor mandrel 4 causes deployment and disengagement of slips 12 will now be described in more detail. Referring to FIGS. 6 and 7, in the preferred embodiment slips 12 include a series of longitudinally oriented teeth 16 that engage correspondingly configured longitudinally oriented teeth 17 on anchor mandrel 4. As anchor mandrel 4 is rotated teeth 16 and 17 effectively operate as a gear system that transfers rotational force to the slips, causing the slips to rotate or pivot about axles 14. As described above, in the embodiment shown in the attached drawings clockwise rotation of anchor mandrel 4 causes teeth 16 and 17 to result in the deployment or outwardly pivotal movement of slips 12 until gripping surfaces 13 are driven into contact with the interior surface of the well casing. Similarly, the gear system defined by the interaction of teeth 16 and 17 account for the disengagement or withdrawal of gripping surfaces 13 from the interior surface of the well casing by pivotal or rotational movement of slips 12 caused by a counter-clockwise rotation of anchor mandrel 4.

In the preferred embodiment teeth 16 and 17 are generally in the configuration of longitudinally oriented wedge-shaped members that generally slope toward their outer apex. This shape encourages the displacement of sand or debris that may collect in the longitudinal cavities between adjacent teeth. This feature has been found to be particularly helpful in wells containing high volumes of sand or particulate matter that may otherwise tend to clog or jam the internal moving parts within the anchor. The configuration of teeth 16 and 17 tends to allow sand or other particulate matter to be driven out from between the teeth as the anchor mandrel is rotated, and thereby assists in setting or retracting of the slips under sandy or otherwise dirty conditions.

As is shown in FIG. 6, it is expected that in most instances three slips will be utilized and they will be spaced apart about anchor mandrel 4 at approximately 120 degree intervals. Under this configuration, and with the above described structure of teeth 16 and 17, it has been found that an approximate 12 degree rotation of anchor mandrel 4 will in most cases be sufficient to "set" slips 12. The precise amount of rotation required to set the slips will, to a large extent, be a function of the size of device 1, slips 12 and well casing 3.

In a preferred embodiment of the invention, anchoring device 1 further includes a plurality of drag blocks 18 that extend radially outward from anchor mandrel 4 to assist in centering and anchoring the device within well casing 3. In the embodiment of the invention shown in FIGS. 1 and 6, there are three drag blocks 18 spaced apart at approximately 120 degree intervals around anchor mandrel 4. Drag blocks 18 are generally rectangular in shape and are biased radially outward by means of a pair of C-springs 19. Springs 19 urge drag blocks 18 radially outward such that their exterior surfaces 20 frictionally engage the interior surface of the well casing. In this way drag blocks 18 serve to hold anchor mandrel 4 centrally within the well casing and also provide a sufficient anchoring force exerted against the interior wall of the casing so as to allow rotational movement of anchor mandrel 4 and deployment or retraction of slips 12.

To accomplish the above described function, drag blocks 18 are received within an outer radial plate 21 that encompasses a portion of anchor mandrel 4. Anchor mandrel 4 and plate 21 may rotate independently of one another thus allowing the drag blocks to temporarily hold anchoring device 1 within the well casing until anchor mandrel 4 can be rotated to deploy slips 12. To allow for independent rotation of plate 21 a pair of bushings 22 are positioned at the interface between plate 21 and anchor mandrel 4. Bushings 22 also help to prevent the ingress of sand and other debris into the interior of device 1. In addition, to further protect the interior mechanisms of device 1 a seal 23 is preferably positioned between anchor mandrel 4 and drive mandrel 5. A further seal 24 is located between anchor mandrel 4 and bottom sub 10.

Device 1 further includes a shear member that assists in holding anchor mandrel 4 and drive mandrel 5 together. It will be appreciated from a thorough understanding of the invention that the shear member may take the form of one or more shear pins positioned between the shear and anchor mandrels or, as shown in the attached Figures, the shear member may be a shear ring 25. Shear ring 25 has an upper end 26, a lower end 27, and a shear zone of reduced tensile strength 28 located between upper and lower ends 26 and 27. In the embodiment shown in FIG. 1, upper end 26 of shear ring 25 is threadably received upon drive mandrel 5. The lower end 27 of the shear ring includes an outwardly projecting flange 29 that is received within a correspondingly configured groove 30 in a locking nut 31 that is threadably received on the exterior of anchor mandrel 4. In this way locking nut 31 will serve to secure anchor mandrel 4 to drive mandrel 5 by effectively hanging the anchor mandrel from flange 29 of shear ring 25. To help limit rotational movement between shear ring 25 and locking nut 31, a set screw 32 may be inserted into a threaded bore within the locking nut such that it bears against the outer surface of the shear ring.

As shown more clearly in the detail drawing comprising FIG. 2, shear zone 28 preferably is comprised of an area of reduced thickness of shear ring 25 that presents a zone of reduced tensile strength. This portion of shear ring 25 will fail when a tensile load that exceeds the yield strength of the shear ring at shear zone 28 is applied between drive mandrel 5 and anchor mandrel 4.

So as to transfer rotational movement and torque between drive mandrel 5 and anchor mandrel 4, torque carrying means are operatively connected between the drive mandrel and the anchor mandrel 4. The torque carrying means may comprise pins, keys or a gear or spline structure between the two mandrels. In the embodiments of the invention shown in the attached drawings, the torque carrying means comprises three torsion pins 33 positioned in bores extending between the drive mandrel and the anchor mandrel and spaced apart by approximately 120 degrees. However, it will also be appreciated by those skilled in the art that the number, size, configuration, spacing and material of manufacture of torsion pins 33 could all be substantially altered while remaining within the broad scope of the invention. The important aspect with respect to the function of the torsion pins is that they be sufficient in size, number and strength to adequately transfer rotational and torsional forces between the drive mandrel and anchor mandrel.

Figure 8:
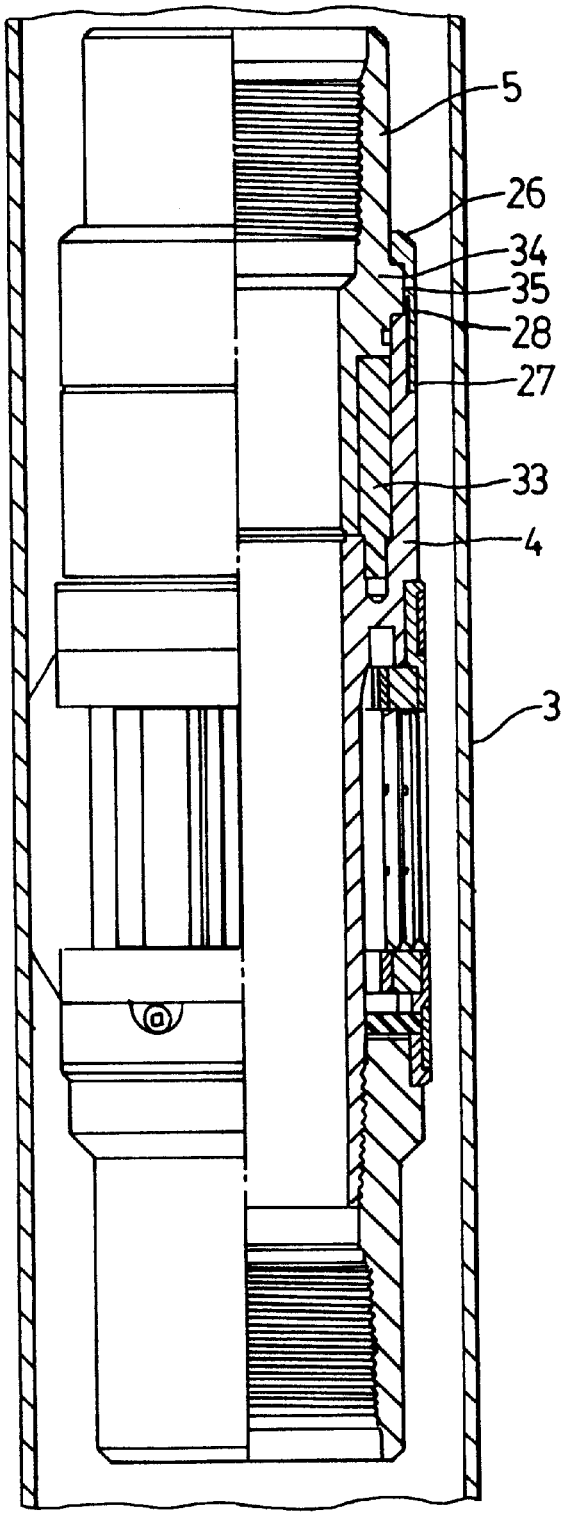

An alternate embodiment of shear ring 25 is shown in FIG. 8. Here lower end 27 of shear ring 25 is threadably secured to anchor mandrel 4. In addition, drive mandrel 5 includes an outwardly projecting flange 34 that is received within a correspondingly configured groove 35 in upper end 26 of shear ring 25. It will thus be appreciated that shear ring 25 will then effectively cause anchor mandrel 4 to be hung from drive mandrel 5, thereby securing the two mandrels together. Once again a shear zone 28 is located within shear ring 25 between upper and lower ends 26 and 27.

Regardless of the particular embodiment of shear ring 25 that is utilized, its function will essentially be the same. In each instance shear ring 25 allows anchor mandrel 4 to effectively be hung from drive mandrel 5 and thereby secure the two mandrels together. As described above, rotational and torsional forces between the mandrels are carried by torsion pins 33. However, in the event that it becomes necessary or desirable to separate anchor mandrel 4 from drive mandrel 5 an upwardly directed force applied to the drive mandrel (while the anchor mandrel has slips 12 deployed or when the anchor mandrel is otherwise jammed in the casing) will cause shear ring 25 to fail or yield along shear zone 28 permitting axial separation of the two mandrels. For example, in situations where the slips, anchor mandrel, and/or drag blocks become "sanded-in" or locked in place by means of sand or other debris accumulating around them, pulling upwardly upon the tubing string and drive mandrel with sufficient force to exceed the yield strength of shear zone 28 will allow the shear ring to fail and permit the tubing string (along with a pump attached thereto) and the drive mandrel to be withdrawn from the well. At that point flushing tools and other devices may be inserted into the well to release and retrieve anchor mandrel 4. Re-assembling the two mandrels then merely requires the replacement of shear ring 25 such that anchor mandrel 4 may once again be secured to drive mandrel 5.

It is to be understood that what has been described are the preferred embodiments of the invention and that it may be possible to make variations to these embodiments while staying within the broad scope of the invention. Some of these variations have been discussed while others will be readily apparent to those skilled in the art.

What is claimed is:

1. An anchoring device for anchoring an oil well tubing string within an oil well casing, the device comprising:

(i) a drive mandrel having an upper end and a lower end, said upper end releasably securable to an oil well tubing string; and, (ii) an anchor mandrel having an upper end that is releasably securable to said drive mandrel, said anchor mandrel further including means for selectively engaging and disengaging the interior surface of an oil well casing, wherein said means for selectively engaging and disengaging the interior surface of an oil well casing comprises a plurality of rotatable slips, said slips having a gripping surface to contact and adhere to the interior surface of an oil well casing such that when said anchor mandrel is rotated in a first direction said slips are rotatably deployed to an engaged position with said gripping surfaces in contact with the interior surface of the oil well casing thereby anchoring said device to the casing and limiting further rotational movement in said first direction and limiting longitudinal movement of said device, and rotation of said anchor mandrel in a second opposite direction causes said slips to be rotatably retracted from said engaged position to a disengaged position such that said gripping surfaces of said slips are withdrawn from contact with the interior surface of the oil well casing, said slips including a series of longitudinally oriented teeth that engage correspondingly configured longitudinally oriented teeth on said anchor mandrel such that rotational force applied to said anchor mandrel is transferred to said slips through the interaction of said teeth on said anchor mandrel with said teeth on said slips.

2. The device as claimed in claim 1 wherein said slips are rotatably mounted on longitudinal axles received within said anchor mandrel.

3. The device as claimed in claim 2 wherein said teeth on said slips and said teeth on said anchor mandrel are generally in the configuration of longitudinally oriented wedge-shaped members that encourage the displacement of sand or debris that may collect in longitudinal cavities between adjacent teeth to thereby assist in the rotational deployment and retraction of said slips under sandy or otherwise dirty conditions.

4. The device as claimed in claim 3 wherein said gripping surfaces of said slips are serrated so as to assist in adhering to the interior surface of the oil well casing when said slips are deployed in their engaged position.

5. The device as claimed in claim 4 including a plurality of drag blocks extending radially outward therefrom to assist in centering and anchoring said device within an oil well casing.

6. The device as claimed in claim 1 wherein said anchor mandrel is releasably securable to said drive mandrel through the use of a shear member, said shear member having an upper end, a lower end and a shear zone of reduced tensile strength located between said upper and lower ends, said lower end of said shear member actively attached to said anchor mandrel and said upper end of said shear member actively attached to said drive mandrel such that tensile load applied between said drive mandrel and said anchor mandrel in excess of the yielding strength of said shear zone causes breakage of said shear member along said shear zone and longitudinal separation of said drive mandrel from said anchor mandrel.

7. The device as claimed in claim 6 wherein said shear member comprises a shear ring.

8. The device as claimed in claim 6 including torque carrying means operatively connected between said anchor mandrel and said drive mandrel to assist in the transference of rotational movement and torque between said drive mandrel and said anchor mandrel.

9. The device as claimed in claim 8 wherein said torque carrying means comprises one or more torsion pins.

10. An anchoring device for anchoring an oil well tubing string within an oil well casing, the device comprising:

(i) an anchor mandrel having attached thereto anchoring means for selectively engaging and disengaging the interior surface of an oil well casing;

(ii) a drive mandrel, said drive mandrel having an upper end releasably securable to an oil well tubing string and a lower end releasably securable to said anchor mandrel;

(iii) torque carrying means operatively connected between said anchor mandrel and said drive mandrel to assist in the transference of rotational movement and torque between said drive mandrel and said anchor mandrel; and, (iv) a shear member having an upper end, a lower end and a shear zone of reduced tensile strength located between said upper and said lower ends, said shear member assisting in releasably securing said drive mandrel to said anchor mandrel such that when said drive mandrel is secured to said anchor mandrel tensile load applied between said drive mandrel and said anchor mandrel in excess of the yielding strength of said shear zone causes breakage of said shear member along said shear zone and separation of said drive mandrel from said anchor mandrel.

11. The device as claimed in claim 10 wherein said shear member comprises a shear ring.

12. The device as claimed in claim 11 wherein an upper end of said shear ring is threadably securable to said drive mandrel.

13. The device as claimed in claim 12 wherein a lower end of said shear ring includes an outwardly projecting flange, said flange received within a correspondingly configured groove in a locking nut attached to said anchor mandrel, said locking nut thereby securing said drive mandrel to said anchor mandrel when said upper end of said shear ring is threadably secured to said drive mandrel.

14. The device as claimed in claim 13 including sealing means between said drive mandrel and said anchor mandrel to limit the ingress of fluids, sand and debris into said anchor mandrel.

15. The device as claimed in claim 14 wherein said torque carrying means comprises one or more torsion pins.

16. The device as claimed in claim 15 including three torsion pins positioned between said anchor mandrel and said drive mandrel and spaced apart by approximately 120 degrees.

17. The device as claimed in claim 11 wherein a lower end of said shear ring is threadably securable to said anchor mandrel.

18. The device as claimed in claim 17 wherein said drive mandrel includes an outwardly projecting flange received within a correspondingly configured groove in an upper end of said shear ring when said shear ring is secured to said anchor mandrel thereby securing said drive mandrel to said anchor mandrel.

19. The device as claimed in claim 15 including sealing means between said drive mandrel and said anchor mandrel to limit the ingress of fluids, sand and debris into said anchor mandrel.

20. The device as claimed in claim 19 wherein said torque carrying means comprises three torsion pins positioned between said anchor mandrel and said drive mandrel and spaced apart by approximately 120 degrees.

21. A drive and shear mechanism for releasably connecting downhole tools to an oil well tubing string in an oil well, the drive and shear mechanism comprising:

(i) a drive mandrel, said drive mandrel having an upper end releasably securable to an oil well tubing string and a lower end operatively connectable to a downhole tool;

(ii) torque carrying means to assist in the transference of rotational movement and torque between said drive mandrel and the downhole tool; and, (iii) a shear member having an upper end, a lower end, and a shear zone of reduced tensile strength located between said upper and said lower ends, said shear member releasably securing said drive mandrel to a downhole tool such that when said drive mandrel is secured to a downhole tool a tensile load applied between said drive mandrel and the downhole tool in excess of the yielding strength of said shear zone of reduced tensile strength causes breakage of said shear member along said shear zone of reduced tensile strength and separation of said drive mandrel and the oil well tubing string from the downhole tool such that said drive mandrel and the oil well tubing string may be extracted from the oil well while the downhole tool and said lower end of said shear member remain within the well.

22. The device as claimed in claim 21 wherein said torque carrying means comprises one or more torsion pins.

23. The device as claimed in claim 21 wherein said shear member comprises a shear ring having an upper end releasably securable to said drive mandrel and a lower end operatively securable to a downhole tool such that tensile or compressive force is transferrable from said drive mandrel through said shear ring to the downhole tool.

24. The device as claimed in claim 23 including one or more torsion pins to assist in the transference of rotational movement and torque between said drive mandrel and the downhole tool.

* * * * *